US005098131A

United States Patent [19]

Tucker

[11] Patent Number: 5,098,131

[45] Date of Patent: Mar. 24, 1992

[54] RETAIL COUPON DOCUMENT

[75] Inventor: Larry H. Tucker, Saddle River, N.J.

[73] Assignee: Larry H. Tucker, Inc., Woodcliff Lake, N.J.

[21] Appl. No.: 728,702

[22] Filed: Jul. 11, 1991

[51] Int. Cl.[5] ..... B42D 15/00

[52] U.S. Cl. ..... 283/105; 206/831; 229/70; 283/56; 283/903; 428/916

[58] Field of Search ..... 428/42, 43, 916; 229/70; 206/831; 283/56, 102, 103, 104, 105, 106, 107, 108, 903

[56] References Cited

U.S. PATENT DOCUMENTS 3,524,782 8/1970 Buske ..... 283/103 X
3,734,544 5/1973 Fishkin et al. ..... 283/56
4,318,235 3/1982 Augeri ..... 206/831 X
4,345,393 8/1983 Price et al. ..... 206/831 X
4,722,554 2/1988 Pettit ..... 283/105
4,817,390 4/1989 Krost ..... 283/56 X

*Primary Examiner*—Paul A. Bell
*Attorney, Agent, or Firm*—Burns, Doane, Swecker & Mathis

[57] ABSTRACT

A coupon document includes top and bottom paper panels releasably secured together around their peripheral edges. An exposed outer side of the top panel has first and second intersecting perforation lines. A hidden inner side of the bottom panel has first and second overlapping coupons imprinted thereon in a general L-shape such that the document can be folded and torn along either of the perforation lines to reveal one of the coupons and destroy the other coupon. The bottom panel is free of intersecting perforation lines which could weaken the revealed coupon.

6 Claims, 2 Drawing Sheets

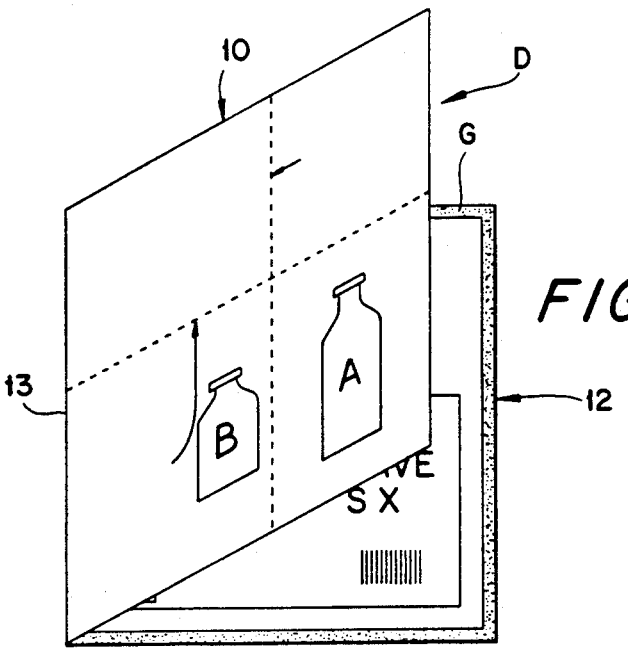
FIG. 3
FIG. 4
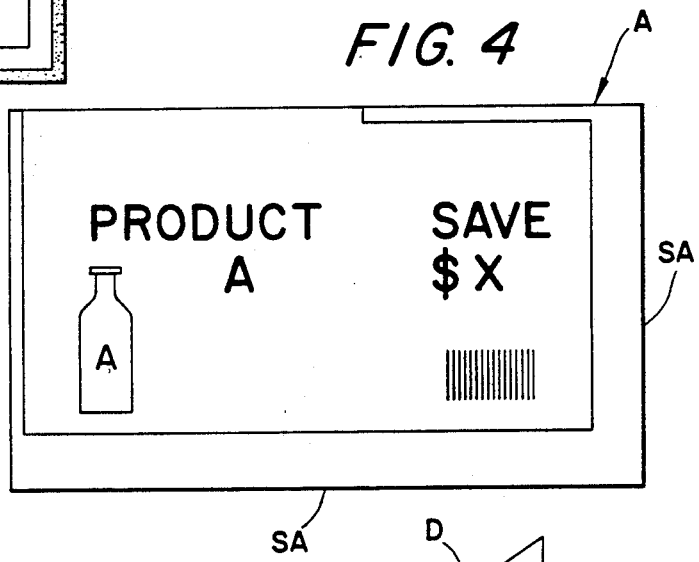
FIG. 5
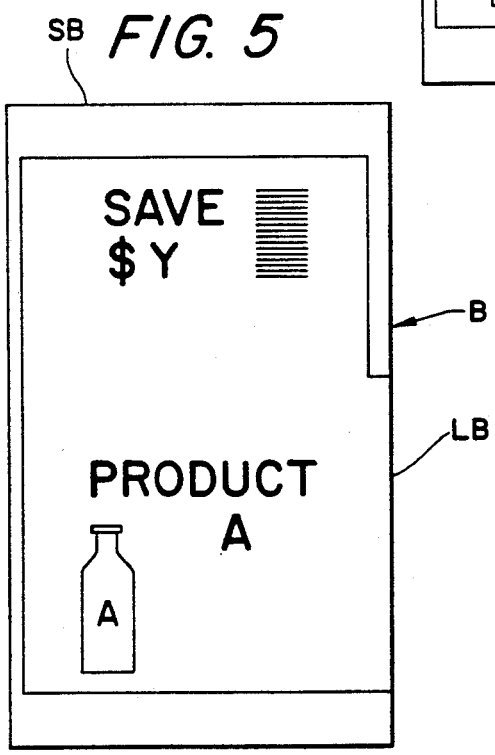
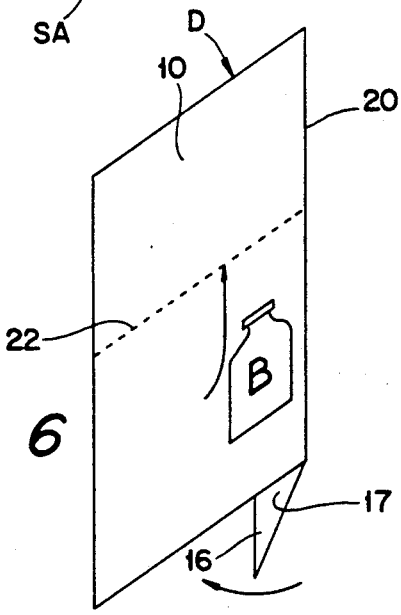
FIG. 6

RETAIL COUPON DOCUMENT

BACKGROUND OF THE INVENTION

This invention relates to retail coupon documents.

Previously proposed in Krost U.S. Pat. No. 4,817,990 is a retail coupon document in which two coupons are hidden from the consumer and wherein one of the coupons is destroyed by the consumer in response to opening the coupon document. A manufacturer is able to issue or sponsor such a coupon document in order to target the users of a competitor's product and present them with an incentive for switching to the sponsor's product. That is, each of the hidden coupons would present the consumer with a value (e.g., a discount) for using the sponsor's product. However, one of the coupons would offer a greater value than the other and would be directed to the user of the competitor's product.

Such direction would be accomplished by means of instructions imprinted on the front side of the document. Those instructions would be calculated to ensure that the opening technique employed by users of the competitor's product would result in the lesser value coupon being destroyed and the greater value coupon being revealed. Conversely, the opening technique employed by users of the sponsor's product would result in the greater value coupon being destroyed and the lesser value coupon being revealed. The greater value received by the user of the competitor's product would serve as an incentive to switch products.

The coupon document itself constitutes top and bottom paper panels glued together along their borders. Each panel thus presents a hidden side (which faces the hidden side of the other section) and an exposed side (which constitutes the front or rear side of the coupon document). Two coupons are imprinted on one of the inner sides in an in-line overlapping fashion, whereby the overlapped region constitutes a common area of the two coupons. Instructions for opening the coupon document are imprinted on the exposed side of the top panel. Those document-opening instructions require the user to cut both panels along imprinted lines which are visible on the exposed side of the top panel. The user is instructed to chose between two different ones of the lines, depending upon whether the user is a user of the competitor's product or the sponsor's product. The user will reveal a coupon for the sponsor's product regardless of which lines are cut along. If the cutting is performed along the lines presented to users of the competitor's product, the lesser value coupon is destroyed and the greater value coupon is revealed, whereas if the cutting is performed along the lines presented to the user of the sponsor's product, then the greater value coupon is destroyed and the lesser value coupon is revealed.

One shortcoming of such a coupon document involves the need for the user to use a cutting tool (e.g., scissors) to perform the cutting operation.

Another prior coupon proposal involves imprinting a pair of coupons on the inner side of the top panel. The coupons intersect at a right angle, whereby the intersecting region constitutes a common area shared by both coupons. The top panel is provided with means for tearing along perforated division lines, namely, a pair of zipper pulls which are integral with the top panel. Each zipper pull is defined by two parallel perforation lines. Those zipper pulls form manually actuable tools which effectively cut through the top panel (but not the bottom panel) along the perforated division lines when pulled by the user. Although this variation requires that only one of the panels of the coupon document be cut and eliminates the need for scissors, it exhibits a number of shortcomings. For instance, the revealed coupon is weakened by the presence of the non-selected perforated division lines and could thus become destroyed (invalidated) in response to normal handling by the user. Also, the pairs of perforation lines which define the pull tabs intersect and define a region of particular weakness at their area of intersection. It has proven difficult to design the outer panel such that the tear tabs can be cleanly pulled past that area of intersection without there resulting an improper tearing of the top panel.

SUMMARY OF THE INVENTION

The present invention relates to a retail coupon document which comprises first and second panels which are removably joined together along their peripheral edges. The first panel includes an exposed top side and a hidden inner side. The second panel includes a hidden inner side facing the hidden inner side of the first panel. One of the inner sides is imprinted with coupon indicia to define first and second retail coupons. The coupons are arranged generally in an L-shape and are mutually overlapped to form a common section therebetween. At least the first panel includes first and second perforated division lines arranged to intersect one another. The first perforated division line passes laterally through the second coupon as the second coupon document is viewed in top plan, and the second perforated division line passes laterally through the first coupon as the coupon document is viewed in top plan. The first and second panels are foldable and tearable along the first perforation line to reveal the first coupon and destroy the second coupon, and are alternatively foldable and tearable along the second perforation line to reveal the second coupon and destroy the first coupon.

Preferably, the coupon indicia is printed on the inner side of the second panel, and the second panel is free of the intersecting perforation lines.

The first and second panels are preferably joined together along one perforated common edge, and by a releasable glue along the remaining edges.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 3 is an exploded perspective view of a coupon document according to the present invention;

FIG. 4 is a front view of a first coupon which can be formed from the first panel;

FIG. 5 is a front view of a second coupon which can be formed from the front panel; and FIG. 6 is a perspective view of the coupon document being folded along one of the perforation lines prior to being torn.

DETAILED DESCRIPTION OF A PREFERRED EMBODIMENT OF THE INVENTION

Depicted in FIG. 3 is a coupon document D according to the present invention in an exploded perspective view. That document comprises top and bottom rectangular paper panels 10, 12 which are interconnected along a common perforated edge 13 and adhered together by glue G extending along the three remaining edges. The panels are formed of paper, and the glue G is of a releasable type enabling the panels to be later peeled apart by a coupon user without destroying the paper or damaging the printing thereon, e.g., the glue can be a type available from the National Starch Co. of Milburn, N.J.

Figure 1:
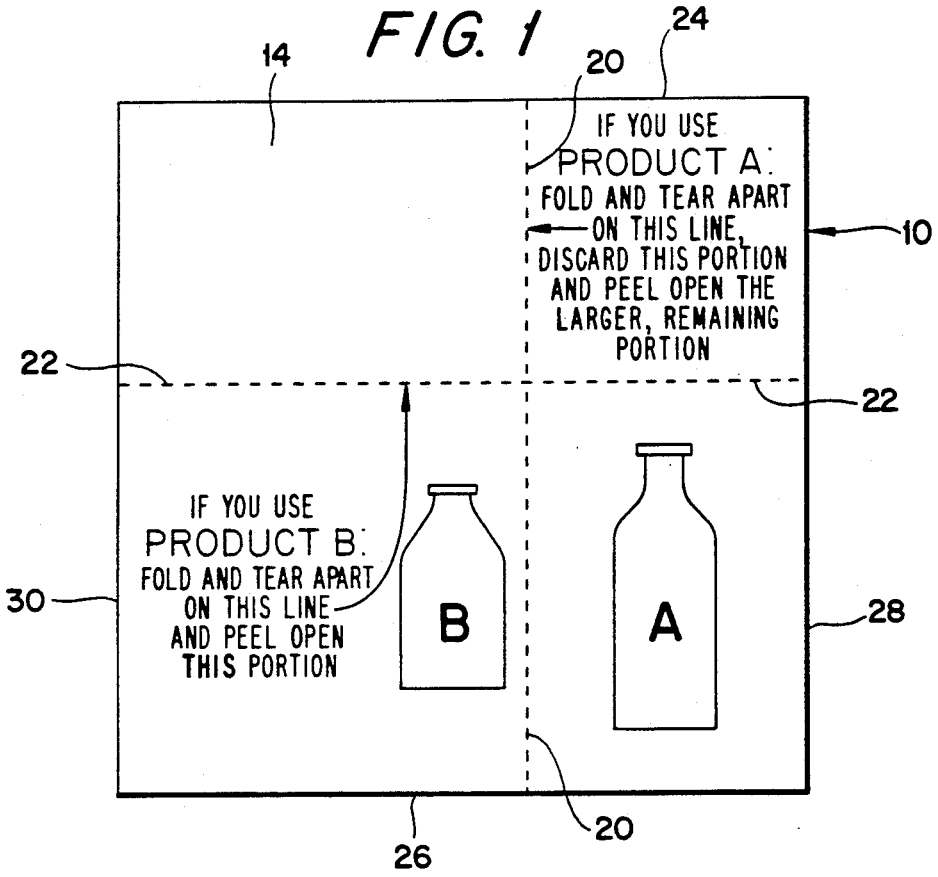
FIG. 1 is a front view of an exposed side of a first panel of a coupon document according to the present invention, with first and second perforation lines thereof being intact.

The top panel 10 includes an outer exposed side 14 depicted in FIG. 1, and an inner side (not shown) which becomes hidden once the panels have been glued together. The bottom panel also has an exposed lower side 17 (FIG. 6), and a hidden inner side 18 (see FIG. 2) which faces the hidden side of the top panel 10.

The top panel 10 is provided with first and second intersecting division lines 20, 22. Each division line is defined by spaced perforations which extend completely through the thickness of the top panel. The first division line 20 extends between two opposing edges 24, 26 of the top panel, and the second division line extends between the remaining two opposing edges 28, 30.

Figure 2:
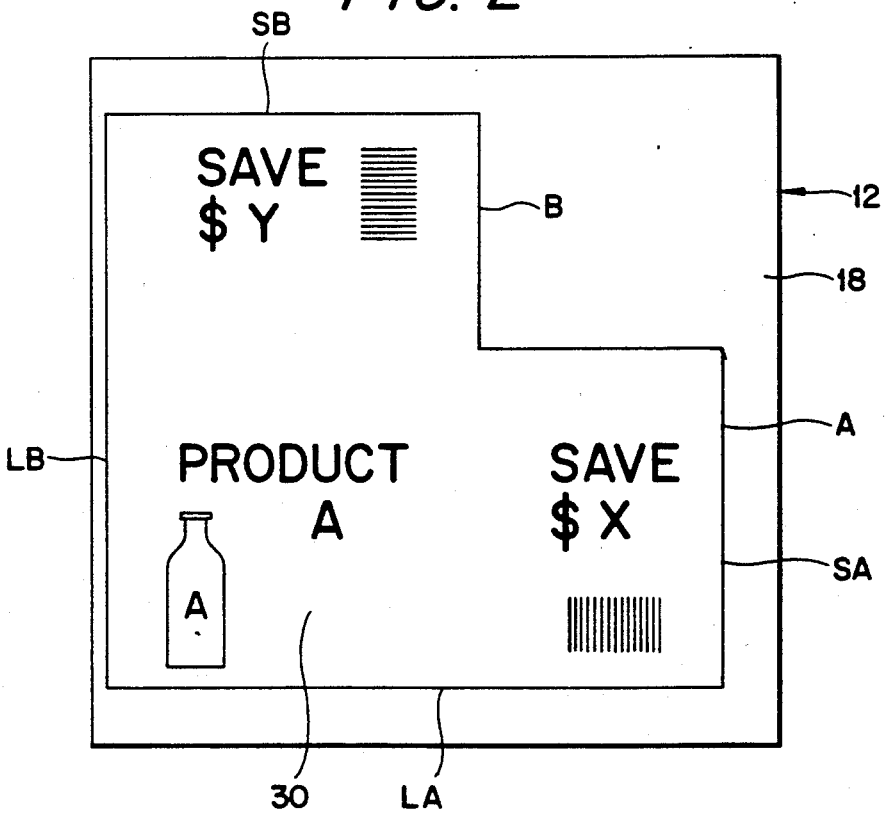
FIG. 2 is a view of an inner, hidden side of a second panel of the coupon document.

FIG. 2 depicts the exposed side 18 of the bottom panel 12. Two coupons A and B are imprinted on that hidden side 16 to intersect one another perpendicularly and generally form an L-shape. Coupon A has a long side LA and a short side SA, whereas coupon B has a long side LB and a short side SB. A rectangular region 30 of intersection or overlap of the coupons A, B is thus defined at the corner of the L-shape. That overlap region 30 is imprinted with instructions to the retailer which are common to both of the coupons A, B. That is, each coupon A, B must include the section 30 in order to be valid.

The coupons A and B are imprinted with different values. For example, coupon A provides a discount of X dollars, and the coupon B provides a discount of Y dollars, with the amount X being greater than the amount Y. Both coupons are valid only for the purchase of product A, however.

When the document D is viewed in top plan, it will be appreciated that the line 20 passes laterally through the coupon A located therebeneath, and the line 22 passes laterally through the other coupon B.

It is to be understood that the bottom panel 12 is preferably not perforated, i.e., is free of perforations 20, 22. The lines depicted in FIG. 2 to outline the two coupons A, B are merely imprinted on the paper. Hence, the bottom panel 12 is not weakened by perforated lines.

During the manufacture of the coupon document, a sheet which constitutes panels 10, 12 is passed through a printing apparatus to have at least the side 14 of the top panel and the side 18 of the bottom panel imprinted with the necessary indicia. Then, the sheet is perforated to form lines 20, 22 and along a line which eventually forms the common edge 13. The glue G is then applied to the sheet, and the sheet is folded along line 13 to press the top and bottom panels 10, 12 against one another.

In practice, a user chooses one of the perforation lines 20, 22 on the basis of the printed instructions, i.e., depending upon whether he/she normally uses product A or B. If the user chooses perforation line 20, he/she manually bends the coupon about that line 20 as shown in FIG. 6 and then manually tears the coupon document along that folded line 20. In so doing, both of the panels 10, 12 will be torn along that line 20 to destroy the coupon B. Even though the bottom panel contains no perforations, the tearing of the bottom panel 12 will be facilitated by the folding step. The user discards the portion 32 of the document disposed to the right of the line 20 and peels apart the top and bottom panels 10, 12 of the remaining portion to reveal the coupon A (FIG. 4).

On the other hand, if the user were to instead fold and tear along the line 22, then the coupon A would be destroyed and the portion of the document located above the line 22 would be discarded. The top and bottom panels 10, 12 of the remaining portion would be peeled apart to reveal the coupon B (FIG. 5).

Various types of offers can be made to the user, causing him or her to choose between the two pull strips 20, 22. For example, a manufacturer of product A may distribute the coupon document whose instructions will direct a user of product A to reveal the first coupon A, and direct a user of a competitor's product B to reveal the second coupon B. As a result, the user of the competitor's product B receives the greater discount for product A (i.e., amount X being greater than amount Y) in order to strongly entice that user to switch to product A. That type of offer is merely exemplary; other types of offers could be made.

It will be understood that the coupons A, B could be imprinted on the inner side of the top panel, instead of on the inner side of the bottom panel. However, it is preferred to provide the coupons A, B on the bottom panel, because that panel has no perforation lines. Hence, the revealed coupon would have no paper-weakening perforations therein. If this advantage is not desired, however, the coupons could be formed on the top panel, and/or the bottom panel could be provided with perforation lines superimposed relative to the lines 20, 22.

It will be appreciated that the coupon document according to the present invention can be torn without the need for a tool or the provision of tear strips. Furthermore, there are only two lines of perforations (instead of four lines when using (tear strips). The document is folded along one of the perforation lines prior to tearing, thus facilitating the tearing step and virtually eliminating the risk that the top panel will be improperly torn at the point of intersection of the lines 20, 22.

In the case that the perforations are formed only in the top panel, and the coupons are imprinted on the bottom panel, the revealed coupon will have no paper-weakening perforations therein and will be less susceptible to being destroyed by normal handling.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A retail coupon document comprising first and second panels removably joined together along their peripheral edges; said first panel including an exposed top side and a hidden inner side; said second panel including a hidden inner side facing said hidden inner side of said first panel; one of said inner sides being imprinted with coupon indicia to define first and second retail coupons arranged generally in an L-shape and mutually overlapped to form a common section therebetween; said first panel including first and second perforated division lines arranged to intersect one another; said first perforated division line passing laterally through said second coupon as said coupon document is viewed in top plan, and said second perforated division line passing laterally through said first coupon as said coupon document is viewed in top plan; said first and second panels being foldable and tearable along said first perforation line to reveal said first coupon and destroy said second coupon, and being alternatively foldable and tearable along said second perforation line to reveal said second coupon and destroy said first coupon.

2. A retail coupon document according to claim 1, wherein said coupon indicia is imprinted on said inner side of said second panel.

3. A retail coupon document according to claim 2, wherein only said first panel contains said intersecting perforation lines.

4. A retail coupon document according to claim 3, wherein said first and second perforation lines intersect one another at a right angle.

5. A retail coupon document according to claim 3, wherein said first and second panels are joined together by one perforated edge, and by a releasable glue along the remaining edges.

6. A retail coupon document according to claim 1, wherein only said first panel contains said intersecting perforation lines.

* * * * *